US010533757B2

(12) United States Patent
Obara et al.

(10) Patent No.: US 10,533,757 B2
(45) Date of Patent: Jan. 14, 2020

(54) FAN AND AIR CONDITIONER

(71) Applicant: Johnson Controls-Hitachi Air Conditioning Technology (Hong Kong) Limited, Hong Kong (CN)

(72) Inventors: Hideshi Obara, Tokyo (JP); Koji Yonekura, Tokyo (JP); Hiroyasu Yoneyama, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 396 days.

(21) Appl. No.: 15/326,729

(22) PCT Filed: Jul. 25, 2014

(86) PCT No.: PCT/JP2014/069636
§ 371 (c)(1),
(2) Date: Sep. 25, 2017

(87) PCT Pub. No.: WO2016/013096
PCT Pub. Date: Jan. 28, 2016

(65) Prior Publication Data
US 2017/0205083 A1 Jul. 20, 2017

(51) Int. Cl.
*F24F 1/0022* (2019.01)
*F24F 1/0047* (2019.01)
(Continued)

(52) U.S. Cl.
CPC ..... *F24F 1/0022* (2013.01); *F04D 25/06* (2013.01); *F04D 25/08* (2013.01); *F04D 29/053* (2013.01);
(Continued)

(58) Field of Classification Search
CPC ..... F24F 1/0022; F24F 1/0047; F24F 1/38; F05D 2250/131; F04D 29/282;
(Continued)

(56) References Cited

U.S. PATENT DOCUMENTS 3,480,373 A * 11/1969 Talbot ..... F04D 29/34 29/889.72
4,012,923 A * 3/1977 Lundgren ..... B21B 35/14 464/90
5,938,405 A 8/1999 Coleman

FOREIGN PATENT DOCUMENTS

CN 1403720 A 3/2003
DE 31 12 146 A1 10/1982
(Continued)

OTHER PUBLICATIONS

International Search Report of PCT/JP2014/069636 dated Oct. 28, 2014.
(Continued)

*Primary Examiner* — Ana M Vazquez
(74) *Attorney, Agent, or Firm* — Mattingly & Malur, PC

(57) ABSTRACT

A fan includes a fan member, a motor that drives to rotate the fan member, and a rotating shaft that is connected to the fan via a vibration prevention member and transmits a turning force of the motor to the fan. The vibration prevention member is an elastic member that connects an inner cylinder made of metal included in the rotating shaft and an outer cylinder made of metal included in the fan member. At least one of an outer circumferential section of the inner cylinder and an inner circumferential section of the outer cylinder is configured in a polygonal shape when viewed from the rotating shaft direction. A turning force received by the vibration prevention member acts as compression stress on an adhesion interface between a vibration prevention material and metal.

11 Claims, 5 Drawing Sheets

(51) Int. Cl.

| | |
|---|---|
| ***F04D 25/08*** | (2006.01) |
| ***F04D 25/06*** | (2006.01) |
| ***F04D 29/053*** | (2006.01) |
| ***F04D 29/28*** | (2006.01) |
| ***F04D 29/66*** | (2006.01) |
| ***F24F 1/0014*** | (2019.01) |
| ***F24F 1/38*** | (2011.01) |
| ***F04D 29/32*** | (2006.01) |
| ***F24F 13/22*** | (2006.01) |

(52) U.S. Cl.
CPC ..... *F04D 29/281* (2013.01); *F04D 29/325* (2013.01); *F04D 29/668* (2013.01); *F24F 1/0014* (2013.01); *F24F 1/0047* (2019.02); *F24F 1/38* (2013.01); *F24F 13/222* (2013.01)

(58) Field of Classification Search
CPC .... F04D 29/263; F04D 29/668; F04D 29/053; F04D 29/325
See application file for complete search history.

(56) References Cited

FOREIGN PATENT DOCUMENTS

| | | | | |
|---|---|---|---|---|
| JP | 58-79095 | U | | 5/1983 |
| JP | 5-10799 | U | | 2/1993 |
| JP | 10-159792 | A | | 6/1998 |
| JP | 11-062891 | A | | 3/1999 |
| JP | 2003-269381 | A | | 9/2003 |
| JP | 2003-286997 | A | | 10/2003 |
| JP | 2003286997 | A | * | 10/2003 |
| JP | 2012-002165 | A | | 1/2012 |

OTHER PUBLICATIONS

Japanese Office Action received in corresponding Japanese Application No. 2016-535598 dated Jun. 26, 2018.
Chinese Office Action received in corresponding Chinese Application No. 201480080832.7 dated Jun. 5, 2018.
Extended European Search Report received in corresponding European Application No. 1489317.4 dated Feb. 19, 2018.
Chinese Office Action received in corresponding Chinese Application No. 201480080832.7 dated Jul. 15, 2019.

* cited by examiner

FAN AND AIR CONDITIONER

TECHNICAL FIELD

The present invention relates to a fan in which a motor and a fan member are fastened via a vibration prevention member and an air conditioner including the fan.

BACKGROUND ART

An air conditioner includes a refrigeration cycle configured by sequentially disposing, in a refrigerant circulation channel in which a refrigerant is enclosed, a compressor that compresses the refrigerant, an indoor heat exchanger that causes the refrigerant and the indoor air to perform heat exchange, an expansion valve that decompresses the refrigerant, and an outdoor heat exchanger that causes the refrigerant and the outdoor air to perform heat exchange. The outdoor heat exchanger is housed in a housing of an outdoor unit together with a fan that sends the air to the outdoor heat exchanger. The indoor heat exchanger is housed in a housing of an indoor unit together with a fan that sends the indoor air to the indoor heat exchanger.

As a form of the outdoor unit, there are, for example, an upper blowing type for blowing the air after the heat exchange from an upper part of the housing and a lateral blowing type for blowing the air after the heat exchange from the front surface of the housing. As the indoor unit, there are various forms according to installation places. In recent years, in particular, in the business field, a ceiling embedded cassette type for embedding a housing in the ceiling and performing suction and blowout of the air via a decorative panel set on the ceiling surface is mainly used. A sectional view of an indoor unit of a conventional air conditioner is shown in FIG. 7. The indoor unit is configured from a decorative panel 101 and a housing 102 connected to the decorative panel 101. The decorative panel 101 includes a suction grill 103 in the center. An outlet 105 including a wind directing plate 104 is disposed around the decorative panel 101. A centrifugal fan 121 consisting of a motor 106 and a fan member 107 connected to a shaft 120 of the motor 106 is set in the housing 102. The motor 106 is operated, whereby the fan member 107 rotates. As indicated by an arrow 115 in FIG. 7, the indoor air is sucked into a suction port 112 of the fan member 107 through the suction grill 103, a filter 116 set in the suction grill 103, and a bell mouth 110 set in the housing 102 and is discharged from a discharge port 113 of the fan member 107 as indicated by an arrow 118. An indoor heat exchanger 108 is disposed to surround the centrifugal fan 121. The air discharged from the fan member 107 is subjected to heat exchange in the indoor heat exchanger 108 and thereafter blown out into a room from the outlet 105 as indicated by an arrow 117. A drain pan 109 for receiving dew condensation water caused in the indoor heat exchanger 108 during cooling is set below the indoor heat exchanger 108. The suction grill 103 is detachable from the decorative panel 101 together with the filter 116. This structure makes it easy to perform cleaning of the filter 116. An electrical component box 111, in which a not-shown control board for controlling the operation of the indoor unit is housed, is set on the lower surface of the bell mouth 110. This structure makes it possible to easily perform maintenance of the electrical component box 111 by opening the suction grill 103. The bell mouth 110 is attached to an inner circumferential part of the drain pan 109 from below. This structure makes it possible to easily perform maintenance such as replacement of the fan member 107 and the motor 106 by opening the suction grill 103 and detaching the bell mouth 110.

FIG. 8 shows a sectional view of the centrifugal fan 121 taken along a plane including a rotating shaft. A vibration prevention member 126, in which a rubber material 125 is joined by vulcanized adhesion between an inner cylinder 123 made of metal and an outer cylinder 124 made of metal, is attached to the center of the fan member 107. The inner cylinder is fit in the shaft 120 of the motor 106. By tightening a nut 127 over a screw provided at the distal end of the shaft 120, the motor 106 and the fan member 107 are fixed. FIG. 9 is a diagram of the vibration prevention member 126 viewed from the direction of the suction port 112 of the fan member. Both of a joining section of the inner cylinder 123 and the rubber material 125 and a joining section of the outer cylinder 124 and the rubber material 125 are circular. When the shaft 120 of the motor 106 rotates, a turning force is transmitted to the fan member 107 via the vibration prevention member 126. An electromagnetic exciting force generated by the motor 106 is absorbed and attenuated by the rubber material 125 to be prevented from being transmitted to the fan member 107. Occurrence of electromagnetic sound is suppressed. At this point, the turning force received by the vibration prevention member 126 acts as shearing stress in a rotating direction on adhesion interfaces between the inner cylinder 123 and the rubber material 125 and between the outer cylinder 124 and the rubber material 125. Further, downward shearing stress by the own weight of the fan always acts on the adhesion interfaces. Therefore, it is necessary to sufficiently secure shearing strength of the adhesion interfaces between the inner cylinder 123 and the rubber material 125 and between the outer cylinder 124 and the rubber material 125. However, in order to sufficiently secure the shearing strength, it is necessary to appropriately perform surface treatment of an outer circumferential section of the inner cylinder 123 or an inner circumferential section of the outer cylinder 124. Therefore, manufacturing cost is increased.

On the other hand, for example, in JP-A-11-62891, a large number of concaves and convexes extending in the axial direction are formed at a predetermined interval in the circumferential direction on the outer circumferential surface of the inner cylinder of the vibration prevention member. Consequently, a part of torque in the rotating direction acts as stress in a direction for compressing rubber. Therefore, it is possible to reduce stress in a shearing direction.

CITATION LIST

Patent Literature

Patent Literature 1: JP-A-11-62891

However, when the concaves and convexes are provided on the adhesion interface, stress concentration occurs in corner portions of the concaves and convexes. In particular, since large tightening torque acts during fan attachment, there is a risk that a crack is caused in the rubber starting from a stress concentrated portion. It is likely to cause imbalance of the fan and an increase in vibration.

SUMMARY OF INVENTION

Technical Problem

A problem to be solved by the present invention is to, in a fan consisting of a fan member including a vibration prevention member and a motor, reduce shearing stress to an adhesion interface between a vibration prevention material and metal, reduce excessive stress due to stress concentration, and improve reliability of the vibration prevention member.

Solution to Problem

A fan of the present invention includes: a fan member; a motor that drives to rotate the fan member; and a rotating shaft that is connected to the fan member via a vibration prevention member and transmits a turning force of the motor to the fan member. The vibration prevention member is an elastic member that connects an inner cylinder made of metal included in the rotating shaft and an outer cylinder made of metal included in the fan member. At least one of an outer circumferential section of the inner cylinder and an inner circumferential section of the outer cylinder is configured as a polygon when viewed from the rotating shaft direction.

Advantageous Effect of Invention

According to the present invention, in a fan consisting of a fan member including a vibration prevention member and a motor, it is possible to reduce shearing stress to an adhesion interface between a vibration prevention material and metal and reduce excessive stress due to stress concentration.

DESCRIPTION OF EMBODIMENTS

A fan of the present invention includes: a fan member; a motor that drives to rotate the fan member; and a rotating shaft that is connected to the fan via a vibration prevention member and transmits a turning force of the motor to the fan. The vibration prevention member is an elastic member that connects an inner cylinder made of metal included in the rotating shaft and an outer cylinder made of metal included in the fan member. At least one of an outer circumferential section of the inner cylinder and an inner circumferential section of the outer cylinder is configured as a polygon when viewed from the rotating shaft direction. According to the present invention, a turning force received by the vibration prevention member acts as compression stress on an adhesion interface between a vibration prevention material and metal. Therefore, it is possible to reduce shearing stress on the adhesion interface between the vibration prevention material and the metal and reduce excessive stress due to stress concentration.

A first embodiment of the present invention is explained with reference to FIG. 1, FIG. 2, and FIG. 3. An air conditioner in this embodiment includes a compressor that compresses a refrigerant, an indoor heat exchanger that causes the refrigerant and the indoor air to perform heat exchange, an indoor fan that blows the air to the indoor heat exchanger, a decompression device that decompresses the refrigerant, an outdoor heat exchanger that causes the refrigerant and the outdoor air to perform heat exchange, and an outdoor fan that blows the air to the outdoor heat exchanger. A fan in this embodiment explained below is applied to at least the indoor fan or the outdoor fan.

Figure 2:
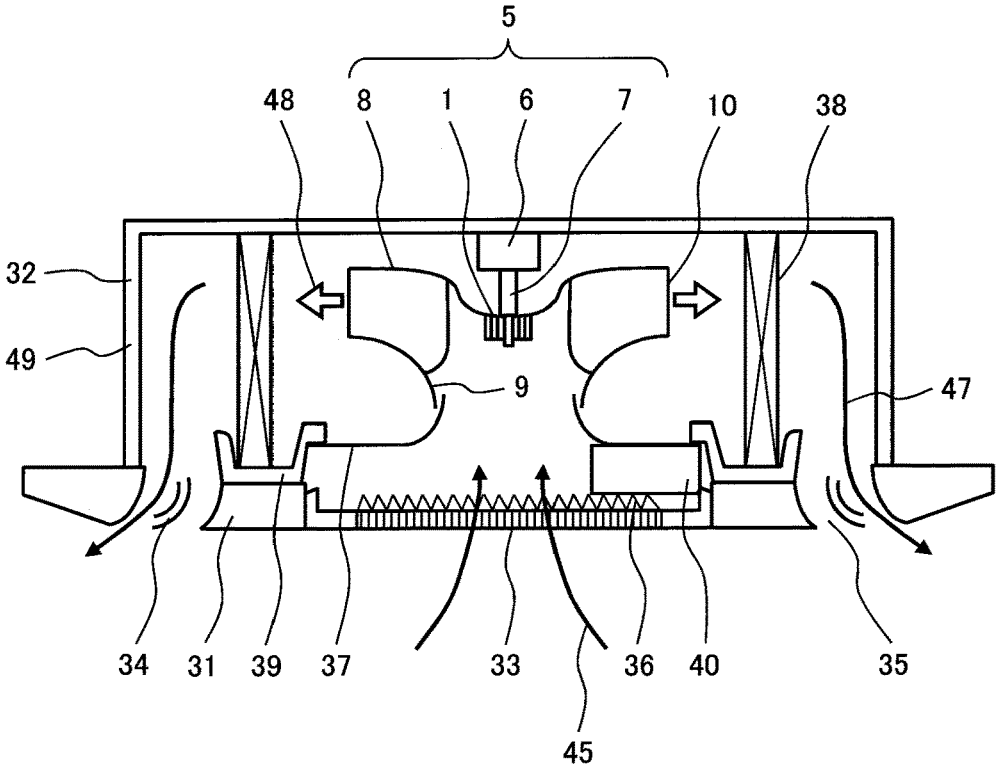
FIG. 2 is a sectional view showing an indoor unit of an air conditioner in the first embodiment.

FIG. 2 is a sectional view showing an indoor unit of the air conditioner. The indoor unit is configured from a decorative panel 31 and a housing 32 connected to the decorative panel 31. The decorative panel 31 includes a suction grill 33 in the center. An outlet 35 including a wind directing plate 34 is disposed around the decorative panel 31. A centrifugal fan 5 including a motor 6 and a fan member 8 connected to a shaft 7 of the motor 6 is set in the housing 32. A vibration prevention member 1 is provided in the center of the fan member 8. The shaft 7 of the motor 6 and the fan member 8 are connected via the vibration prevention member 1. The motor 6 is operated, whereby the fan member 8 rotates. As a result, as indicated by an arrow 45 in FIG. 2, the indoor air is sucked into a suction port 9 of the fan member 8 through the suction grill 33, a filter 36 set in the suction grill 33, and a bell mouth 37 set in the housing 32. The indoor air is discharged from a discharge port 10 of the fan member 8 as indicated by an arrow 48. An indoor heat exchanger 38 is disposed to surround the centrifugal fan 5. The air discharged from the fan member 8 is subjected to heat exchange in the indoor heat exchanger 38 and thereafter blown out into a room from the outlet 35 as indicated by an arrow 47.

A drain pan 39 for receiving dew concentration water caused in the indoor heat exchanger 38 during cooling is set below the indoor heat exchanger 38. The suction grill 33 is detachable from the decorative panel 31 together with the filter 36. This structure makes it easy to perform cleaning of the filter 36. An electrical component box 40, in which a not-shown control board for controlling the operation of the indoor unit is housed, is set on the lower surface of the bell mouth 37. This structure makes it possible to easily perform maintenance of the electrical component box 40 by opening the suction grill 33. The bell mouth 37 is attached to an inner circumference section of the drain pan 39 from below. This structure makes it possible to easily perform maintenance such as replacement of the fan member 8 and the motor 6 as well by opening the suction grill 33 and detaching the bell mouth 37.

Figure 1:
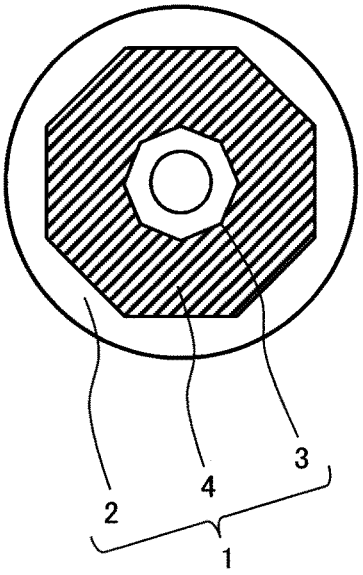
FIG. 1 is a plan view of a vibration prevention member in a first embodiment viewed from the direction of a suction port of a fan member.

FIG. 1 is a plan view of the vibration prevention member 1 viewed from the direction of the suction port 7 of the fan member 6. In the vibration prevention member 1, an elastic member (a rubber material 4) is joined by vulcanized adhesion between an inner cylinder 2 made of metal and an outer cylinder 3 made of metal. In this embodiment, a joining section of the inner cylinder 2 made of metal and the rubber material 4 and a joining section of the outer cylinder 3 made of metal and the rubber material 4 are formed as an octagon. When the shaft 9 of the motor 8 rotates, a turning force is transmitted to the fan member 6 via the vibration prevention member 1. An electromagnetic exciting force generated by the motor 8 is absorbed and attenuated by the rubber material 4 to be prevented from being transmitted to the fan member 6. Occurrence of electromagnetic sound is suppressed. Since both of the joining section of the inner cylinder 2 and the rubber material 4 and the joining section of the outer cylinder 3 and the rubber material 4 are octagonal, on adhesive interfaces between the inner cylinder 2 and the rubber material 4 and between the outer cylinder 3 and the rubber material 4, a part of the turning force received by the vibration prevention member 1 acts as a compression stress against a joining surface of the inner cylinder 2 or the outer cylinder 3. Therefore, it is possible to reduce shearing stress compared with when the joining section is circular. Even if an adhesion failure occurs, it is possible to receive the turning force. Therefore, it is possible to transmit the turning force of the fan member.

Figure 3:
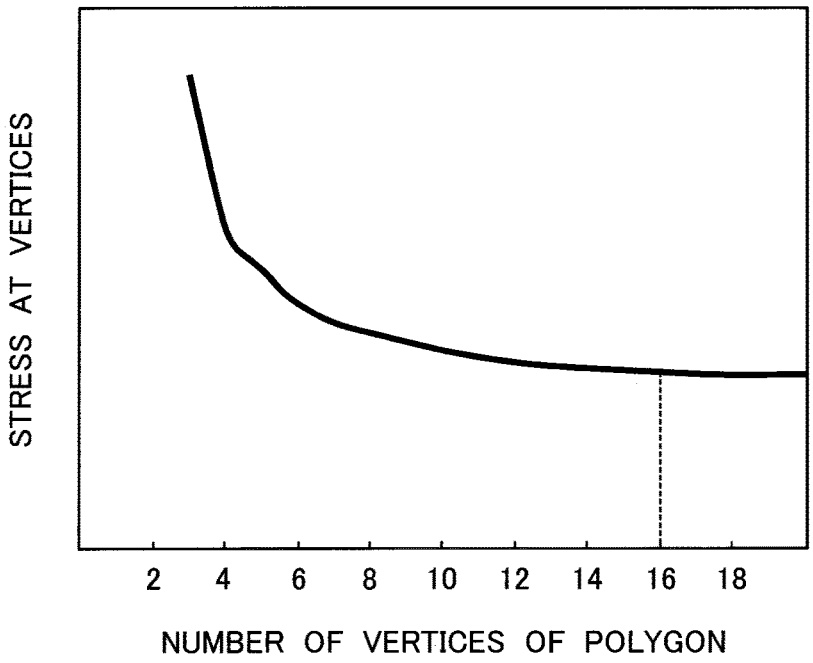
FIG. 3 is a graph showing a relation between the number of vertices of a polygon of a joining section of an inner cylinder and a rubber material and stress at the vertices.

FIG. 3 is a graph showing calculation values of stress near vertices in the case in which the number of vertices of a polygon of the joining section of the inner cylinder 2 and the rubber material 4 is changed. By forming the joining section as the polygon, it is possible to reduce shearing stress in the portions of the sides of the polygon. However, stress concentration is sometimes caused in the portions of the vertices of the polygon. It is seen from FIG. 3 that, whereas the stress suddenly increases when the number of the vertices of the polygon decrease, the stress hardly changes when the number of vertices of the polygon is equal to or larger than sixteen. When the vertices of the polygon increase, an area capable of receiving the turning force as the compression stress decreases. Therefore, it is desirable to reduce the number of the vertices in a range in which reliability can be secured. Therefore, it is desirable to select the number of the vertices in a range of 6 to 16.

Note that, in this embodiment, both of the joining section of the inner cylinder 2 and the rubber material 4 and the joining section of the outer cylinder 3 and the rubber material 4 are octagonal. However, for example, for convenience in manufacturing, it is also possible to form only one of the joining sections as a polygon and form the other as a circle as in the past.

Figure 4:
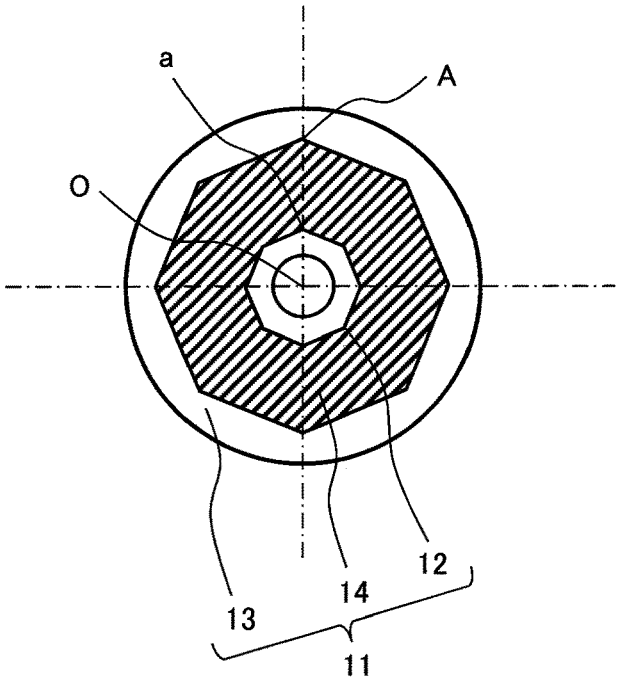
FIG. 4 is a plan view of a vibration prevention member in a second embodiment viewed from the direction of a suction port of a fan member.

A second embodiment of the present invention is explained with reference to FIG. 4. FIG. 4 is a plan view of a vibration prevention member 11 of a fan viewed from the direction of a suction port of a fan member. As in the first embodiment, the vibration prevention member 11 is configured by joining, with vulcanized adhesion, a rubber material 14 between an inner cylinder 12 made of metal and an outer cylinder 13 made of metal.

Both of a joining section of the inner cylinder 12 and the rubber material 14 and a joining section of the outer cylinder 13 and the rubber material 14 are formed in octagonal similar shapes. In this embodiment, the vibration prevention member 11 is configured such that one vertex "a" of a polygon, which is the outer circumference of the inner cylinder 12, one vertex A of a polygon, which is the inner circumference of the outer cylinder 13, and a center point O of the polygons are aligned in this order. The outer circumference of the inner cylinder 12 and the inner circumference of the outer cylinder 13 are formed as similar octagons. Therefore, the other vertices of the outer circumference are also aligned with any vertices and the center point O of the polygons. Consequently, compared with the first embodiment, a change in the thickness in the radial direction of the rubber material 14 decreases. A vibration prevention effect of an elastic material such as rubber is affected by thickness. The vibration prevention effect decreases when the thickness is small. When the change in the thickness in the radial direction is large, it is likely that a portion where the thickness is small is formed and the vibration prevention effect decreases. In this embodiment, since the change in the thickness can be reduced, it is possible to suppress the decrease in the vibration prevention effect.

Figure 5:
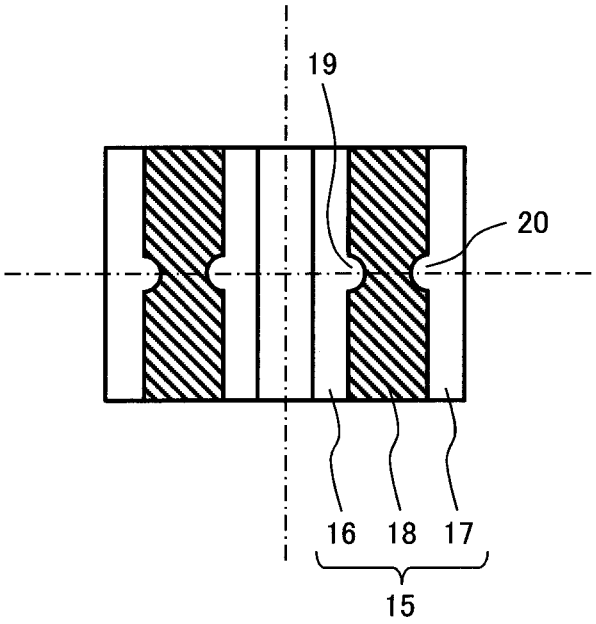
FIG. 5 is a sectional view of a vibration prevention member of a fan in a third embodiment taken along a plane including a rotating shaft of a fan member.

A third embodiment of the present invention is explained with reference to FIG. 5. FIG. 5 is a sectional view of a vibration prevention member 15 of a fan taken along a plane including a rotating shaft of a fan member. As in the embodiments explained above, the vibration prevention member 15 is configured by joining, with vulcanized adhesion, a rubber material 18 between an inner cylinder 16 made of metal and an outer cylinder 17 made of metal.

In this embodiment, in an outer circumferential section of the inner cylinder 16 and an inner circumferential section of the outer cylinder 17, convex shapes 19 and 20 projecting toward the rubber material 18 side are provided in the centers in the axial direction of the outer circumferential section and the inner circumferential section. Ina fan member in which a suction port is provided vertically downward, downward gravity is always applied to the fan member. If the rubber material 18 and the inner cylinder 16 or the outer cylinder 17 are disjoined because of an adhesion failure or the like, the fan member drops. However, in the fan member in this embodiment, since the rubber material 18 can be supported by the convex shapes 19 and 20 in the centers, it is possible to prevent the fan member from dropping.

Note that the positions of the convex shapes 19 and 20 do not have to be the centers in the axial direction. The convex shapes 19 and 20 may be provided in different positions in the axial direction in the inner cylinder 16 and the outer cylinder 17. By providing the convex shapes 19 and 20 in the centers in the axial direction as in this embodiment, the vibration prevention member becomes symmetrical in the up-down direction. Workability is improved because it is unnecessary to take into account the up-down direction during manufacturing of the fan member. A convex shape may be provided in only one of the inner cylinder 16 and the outer cylinder 17. If an inner cylinder and an outer cylinder are manufactured by die-cast, it is possible to reduce man-hour of cutting and reduce cost. Further, the convex shape in this embodiment may be changed to a concave shape formed by recessing the inner cylinder or the outer cylinder in the opposite direction of the rubber material.

Figure 6:
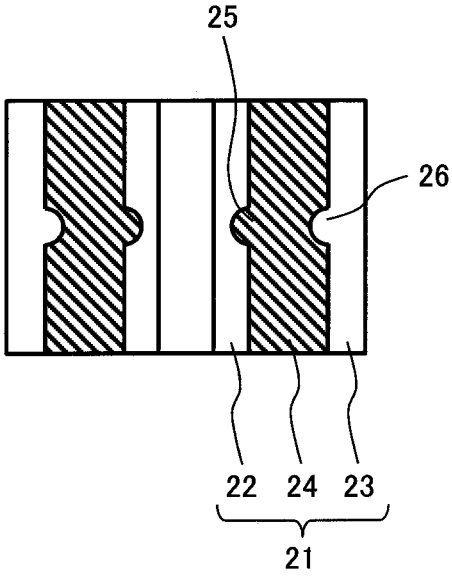
FIG. 6 is a sectional view of a vibration prevention member of a fan in a fourth embodiment taken along a plane including a rotating shaft of a fan member.
Figure 7:
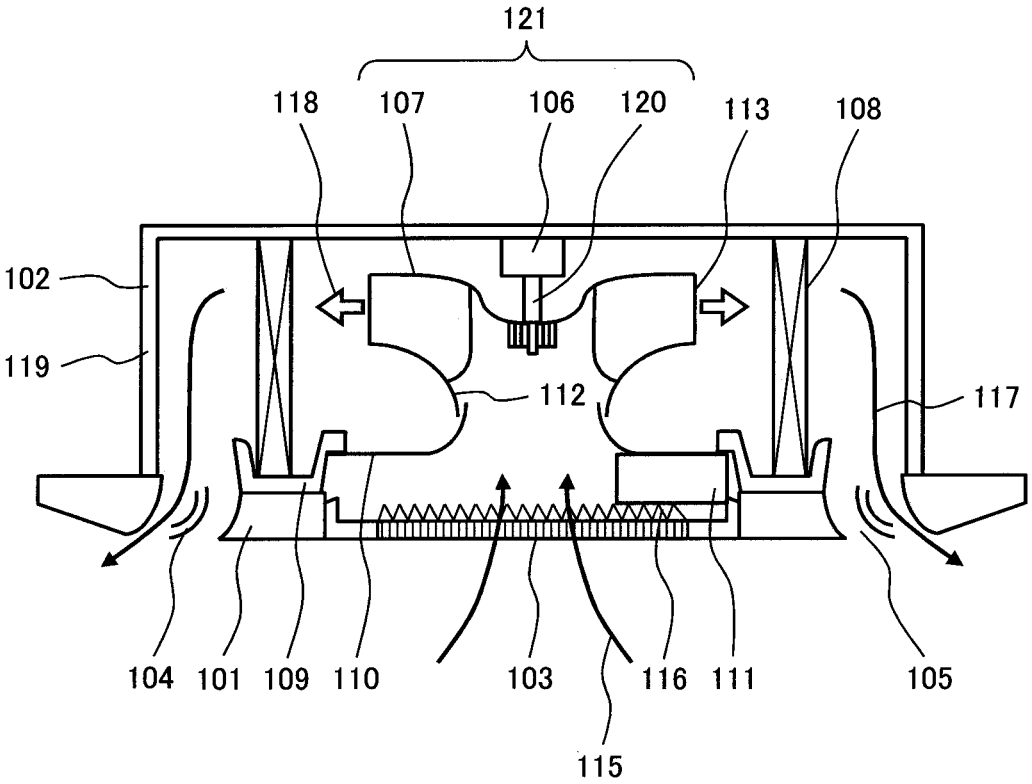
FIG. 7 is a sectional view showing an example of an indoor unit of a conventional air conditioner.
Figure 8:
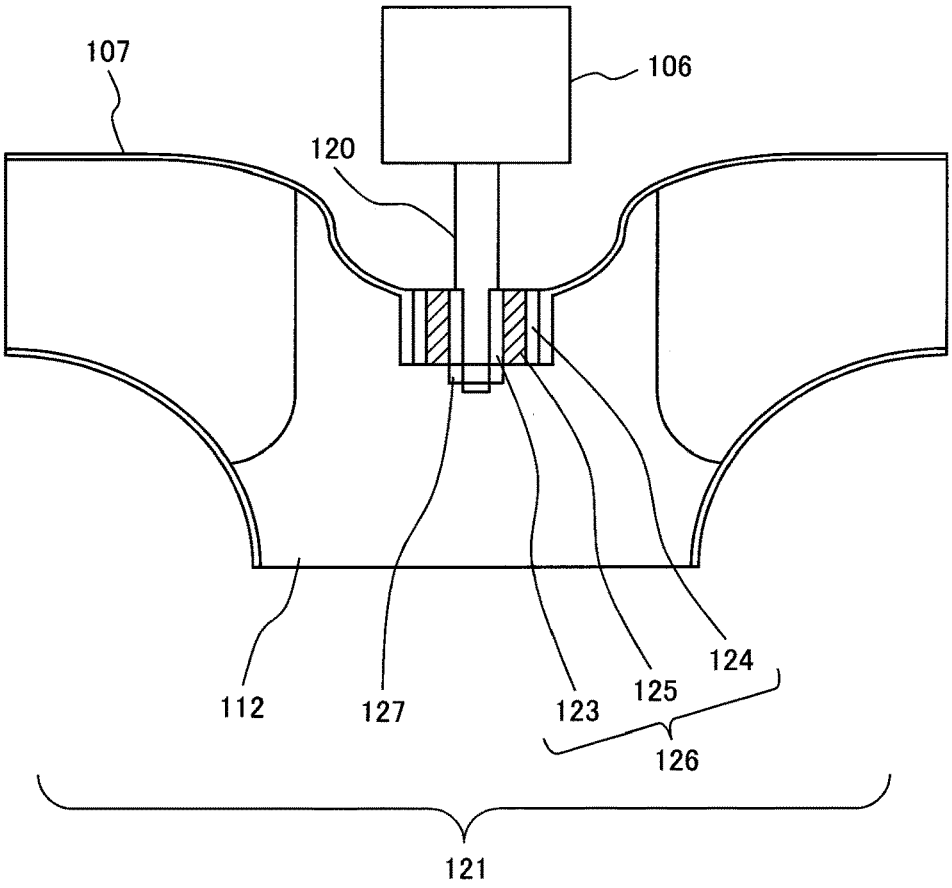
FIG. 8 is a sectional view of a conventional centrifugal fan taken along a plane including a rotating shaft.
Figure 9:
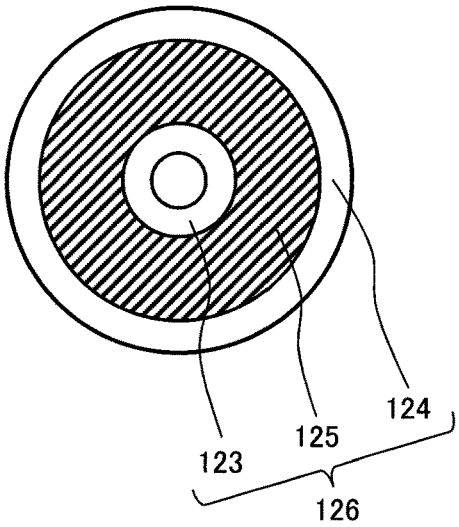
FIG. 9 is a plan view of a conventional vibration prevention member viewed from the direction of a suction port of the fan member.

A fourth embodiment of the present invention is explained with reference to FIG. 6. FIG. 6 is a sectional view of a vibration prevention member 21 of a fan taken along a plane including a rotating shaft of a fan member. As in the embodiments explained above, the vibration prevention member 15 is configured by joining, with vulcanized adhesion, the rubber material 18 between the inner cylinder 16 made of metal and the outer cylinder 17 made of metal.

In this embodiment, a concave shape 25 recessed in the opposite direction of a rubber material 24 is provided in an outer circumferential section of the inner cylinder 22 and a convex shape 26 projecting toward the rubber material 24 is provided in an inner circumferential section of the outer cylinder 23. The concave shape 25 of the inner cylinder 22 and the convex shape 26 of the outer cylinder 23 are provided in the same position in the axial direction of the vibration prevention member 21. In the vibration prevention member in the third embodiment, it is likely that the thickness of the rubber material decreases in the convex shape section and vibration prevention performance is deteriorated. On the other hand, in this embodiment, if the rubber material 24 and the inner cylinder 22 or the outer cylinder 23 are disjoined because of an adhesion failure or the like, the rubber material 24 can be supported by the concave shape 25 of the inner cylinder 22 or the convex shape 26 of the outer cylinder 23. In addition, the thickness in the radial direction of the rubber material 24 can be fixed over the entire length in the axial direction of the vibration prevention member 21. Therefore, it is possible to suppress a decrease in vibration reduction of the vibration prevention member 21. Note that the same effect can be obtained even if the concave shape 25 is formed in a convex shape and the convex shape 26 is formed in a concave shape.

In the embodiments, the rubber material is used in the vibration prevention member. However, an elastic body such as elastomer can be used. The fan is the centrifugal fan including the centrifugal fan member. However, the present invention can also be applied to fans of other forms such as an axial fan and a multi-blade fan. Further, in the embodiments, the example is explained in which the fan of the present invention is applied to the indoor unit of the ceiling embedded cassette type. However, the present invention can also be applied to indoor units of other forms and outdoor units of an upper blowing type, a lateral blowing type, and the like.

REFERENCE SIGNS LIST

1, 11, 15, 21, 126 vibration prevention member
2, 12, 16, 22, 123 inner cylinder
3, 13, 17, 23, 124 outer cylinder
4, 14, 18, 24, 125 rubber material
5, 121 centrifugal fan
6, 106 motor
7, 120 shaft
8, 107 fan member
9, 112 suction port of the fan member

The invention claimed is:

1. A fan comprising:
a fan member;
a motor that drives to rotate the fan member; and
a rotating shaft that is connected to the fan member via a vibration prevention member and transmits a turning force of the motor to the fan member,
wherein the vibration prevention member is composed of an elastic member, an inner cylinder made of metal and an outer cylinder made of metal, wherein the elastic member is joined to the inner cylinder and the outer cylinder,
wherein the fan member contacts an outer surface of the outer cylinder of the vibration prevention member,
wherein at least one of an outer circumferential section of the inner cylinder and an inner circumferential section of the outer cylinder is configured as a polygon when viewed from a rotating shaft direction, and
wherein a tuning force of the motor is transmitted to the fan member via the outer cylinder, the elastic member and the inner cylinder of the vibration prevention member upon rotation of the rotating shaft.

2. The fan according to claim 1, wherein the polygon is in a range of a hexagon to a hexadecagon.

3. The fan according to claim 1, wherein
the outer circumferential section and the inner circumferential section are same polygons when viewed from an axial direction of the motor, and
one vertex of the polygon of the outer circumferential section, one vertex of the polygon of the inner circumferential section, and a center point of the polygon of the inner circumferential section are aligned in this order.

4. The fan according to claim 1, wherein a convex shape projecting toward the vibration prevention member is formed in at least one of the outer circumferential section and the inner circumferential section.

5. The fan according to claim 4, wherein the convex shape is formed in a center in an axial direction of the outer circumferential section or the inner circumferential section.

6. The fan according to claim 1, wherein a concave shape recessed toward an opposite direction of the vibration prevention member is formed in at least one of the outer circumferential section and the inner circumferential section.

7. The fan according to claim 6, wherein the concave shape is formed in a center in an axial direction of the outer circumferential section or the inner circumferential section.

8. The fan according to claim 1, wherein
a convex shape projecting toward the vibration prevention member is formed in the outer circumferential section, and
a concave shape recessed toward an opposite direction of the vibration prevention member is formed in the inner circumferential section and in a position in an axial direction corresponding to the convex shape.

9. The fan according to claim 1, wherein
a convex shape projecting toward the vibration prevention member is formed in the inner circumferential section, and
a concave shape recessed toward an opposite direction of the vibration prevention member is formed in the outer circumferential section and in a position in an axial direction corresponding to the convex shape.

10. The fan according to claim 1, wherein the elastic member is rubber or elastomer.

11. An air conditioner comprising:
a compressor that compresses a refrigerant;
an indoor heat exchanger that causes the refrigerant and indoor air to perform heat exchange;
an indoor fan that blows the air to the indoor heat exchanger;
a decompression device that decompresses the refrigerant;
an outdoor heat exchanger that causes the refrigerant and outdoor air to perform heat exchange; and
an outdoor fan that blows the air to the outdoor heat exchanger, wherein
the fan according to claim 1 is used in at least the indoor fan or the outdoor fan.

* * * * *